United States Patent [19]

Belokin, Jr.

[11] 4,106,828

[45] Aug. 15, 1978

[54] DISPLAY FIXTURE

[76] Inventor: Paul Belokin, Jr., R.R. #4, Hayward, Wis. 54843

[21] Appl. No.: 768,148

[22] Filed: Feb. 14, 1977

[51] Int. Cl.[2] ..... A47B 87/00

[52] U.S. Cl. ..... 312/107; 312/108; 312/198; 248/174; 108/64

[58] Field of Search ..... 312/107, 108, 111, 140, 312/198; 108/64; 46/25, 26, 31; 248/222.1, 174, 354.1; 217/73, 65

[56] References Cited

U.S. PATENT DOCUMENTS

| | | | |
|---|---|---|---|
| 776,042 | 11/1904 | Acheson | 312/107 |
| 2,691,242 | 10/1954 | Young | 46/25 |
| 3,144,881 | 8/1964 | Sproull | 46/31 |
| 3,289,322 | 12/1966 | Patrick | 46/31 |
| 3,410,474 | 11/1968 | Keil | 46/25 |
| 3,433,183 | 3/1969 | Yarme et al. | 108/64 |
| 3,644,608 | 2/1972 | Overby | 312/107 |
| 3,701,214 | 10/1972 | Sakamoto | 46/26 |
| 3,869,992 | 3/1975 | Kramer | 108/64 |

FOREIGN PATENT DOCUMENTS

| | | | |
|---|---|---|---|
| 2,260,313 | 9/1975 | France | 312/140 R |

*Primary Examiner*—Casmir A. Nunberg
*Assistant Examiner*—Victor N. Sakran
*Attorney, Agent, or Firm*—James E. Nilles

[57] ABSTRACT

A molded unit of polystyrene foam having one corner and three sides which with other like units may be compactly nested for storage yet is readily assembled in a wide variety of knock-down arrangements for merchandise display, the units being used in various assembly configurations and orientations to display a wide range of goods in different presentations, two units preferably being capable of providing a six-sided hollow configuration having five walls with twelve equal length corners and one open side.

2 Claims, 19 Drawing Figures

FIG. 8
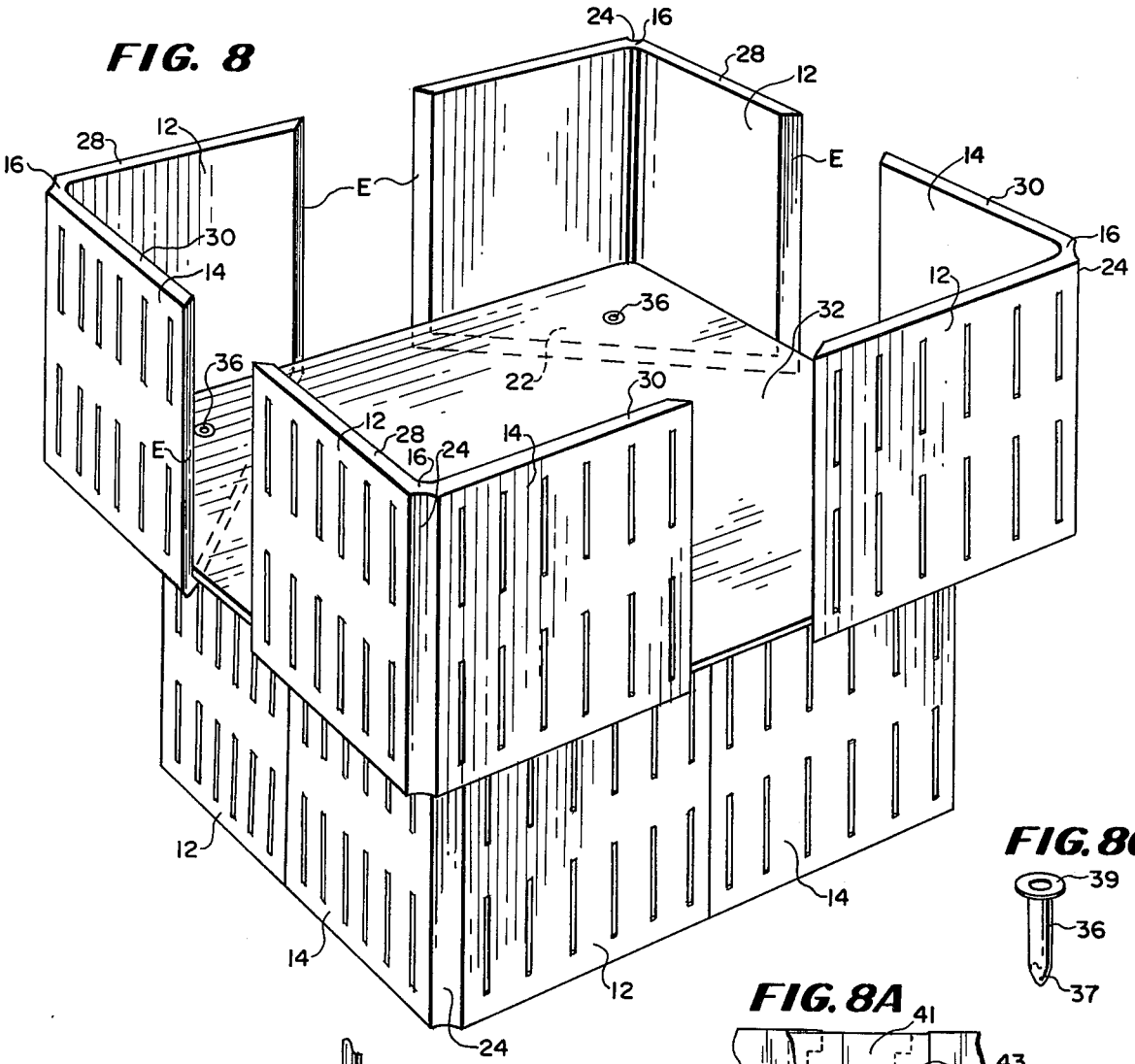
FIG. 8C
FIG. 8A
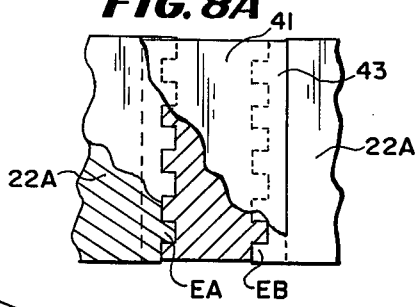
FIG. 9
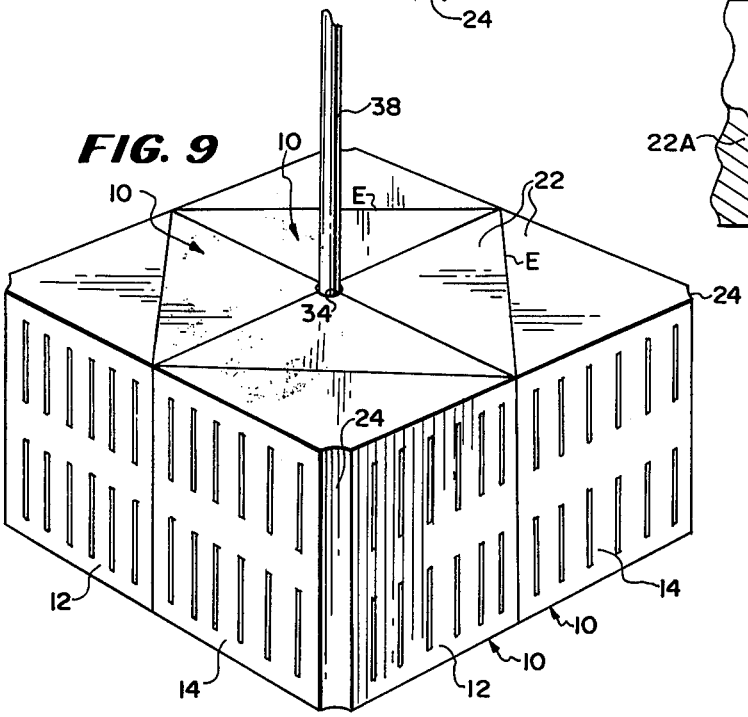
FIG. 8B
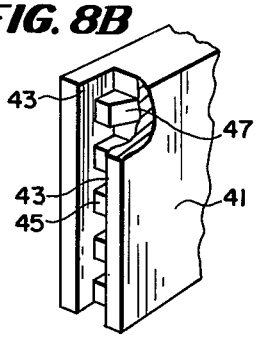

DISPLAY FIXTURE

DESCRIPTION OF THE INVENTION

Although arrangeable blocks, shelves, supports and container elements have been used by merchants to display merchandise as well as confine it to limited spaces or levels for inspection and dispensing purposes, the inventory of fixtures of various shapes, sizes and functions heretofore employed has had to be extensive to avoid monotony in the presentation and displaying of merchandise. Moreover, even with substantial diversification of conventional display equipment, a large expense is conventionally involved with an inventory of differing designs and types which stylewise may be incompatible, thereby requiring extensive numbers of each group of display fixtures of different styles.

In the present invention it is preferred to employ a single novel form referred to as a unit which in numbers can be nested or stacked for compact storage but when used provides many visually compatible changes in appearance of a wide variety of merchandise display fixtures. More particularly, a single set of units can be nested and stored in large numbers in little overall space, yet made up into triangular and square fixtures with inside and outside contours and decorative displays of architectural forms, shapes and sizes of display fixtures and containers of substantial size.

The units are featherweight but firm and strong and easy to handle. Not only may they be used to provide attention-commanding displays, but also recessive displays, in various combinations depending upon viewing levels and perspective points. Straight-line contours accentuate corner, curve and depth study displays, as well as illusions of permanence and solidarity. Display pieces are very light in weight and of a size to be readily handled and arranged in decorating windows and floor displays. They depict solidarity and strength, as well as upon occasion being used to represent articles as though they are just unpacked from sturdy containers, including containers just opened to reveal contents.

Moreover, the display equipment, although not infrangible, has substantial body and is inexpensive. It may be carved, used for special effects, discarded and replaced with little cost. Changes can readily be made in colors, finishes and effects. Openings in walls provide further depth and three-dimensional effects. Displays may be mounted merely by sticking pins or pegs through a portion of the material of which the units are made. The displays are light enough of weight to be made or stored any place, manually carried and placed in a store window or on a floor or table space. Two or more units assembled will support the weight of a man and where two or more are joined they may receive others and also support standards for signs of substantial height.

Preferably, the display units do not constitute a shipping container, although if desired, they can be used as featherweight packing for supporting articles in a discardable shipping container.

A further object for versatility is to provide a novel form which has the greatest number of significant positions and orientations by itself and in combinations with others like it to provide a great number of geometric effects where contour lines are disposed at angles divisible by 45° for depth, perspective and elevation perception, each unit serving distinctively alone or as a part of a group.

A further object of the invention is to provide a display of units easily supported with respect to each other or as a unit by dowels or adhesive tape or both.

IN THE DRAWINGS

FIG. 8 illustrates an organizational modification of the units in FIG. 7 with an expanded upper bin size having side openings, or with side coupling closures as illustrated in FIGS. 8A, 8C and 8B for the units illustrated in FIGS. 1–3;

FIG. 9 illustrates a base arrangement such as used in FIGS. 7 and 8 with the units disposed as shown in FIG. 4 or 1A to provide a support for a price-carrying pole;

DESCRIPTION OF PREFERRED EMBODIMENT

Figure 1:
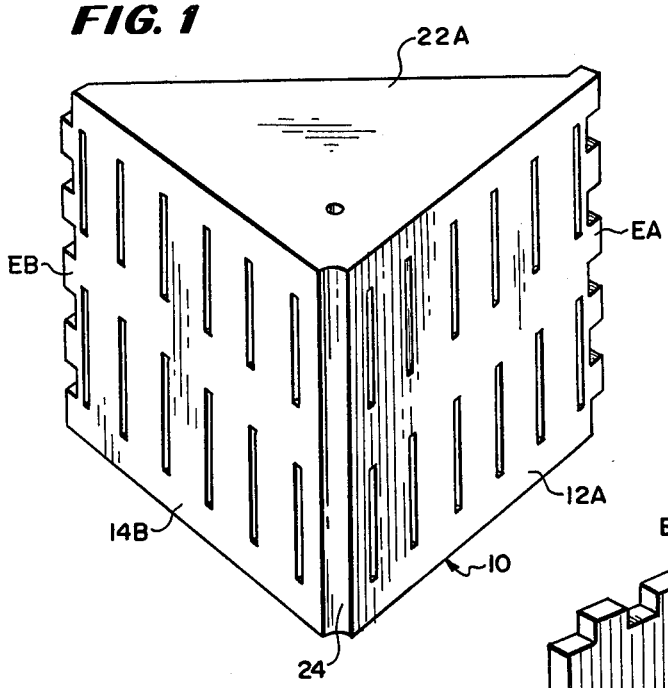
FIGS. 1, 2 and 3 and 1A, 2A and 3A are different perspective views of two like embodiments of a single unit embodying the invention, each viewed as in three different positions and orientations, a possible fourth being a mirror view of FIG. 2 with like numerals referring to like parts.
Figure 2:
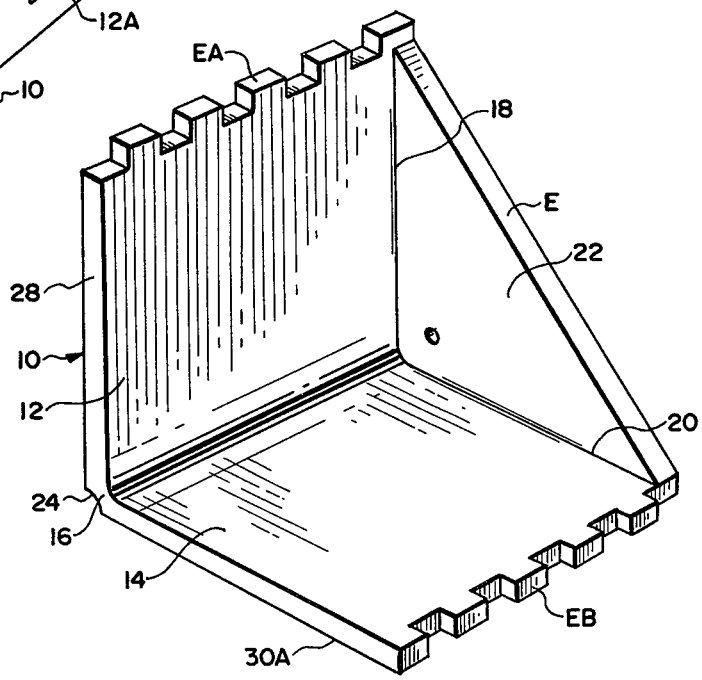
Figure 3:
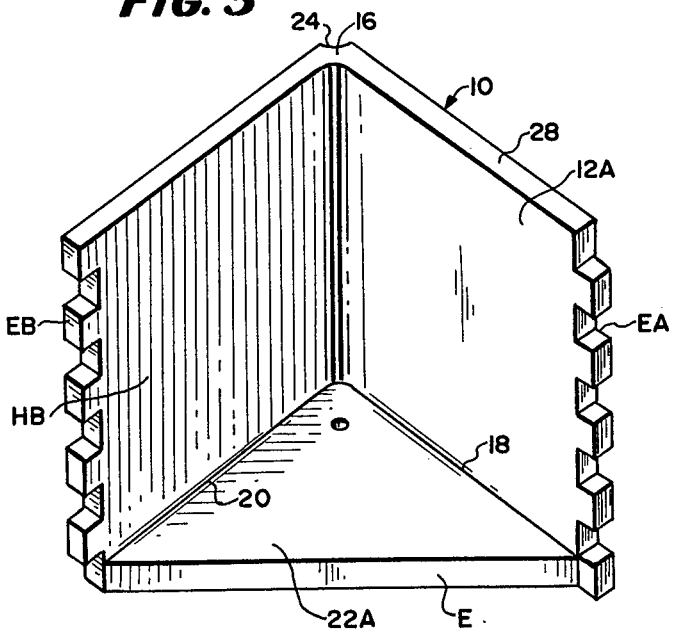
Figure 1A:
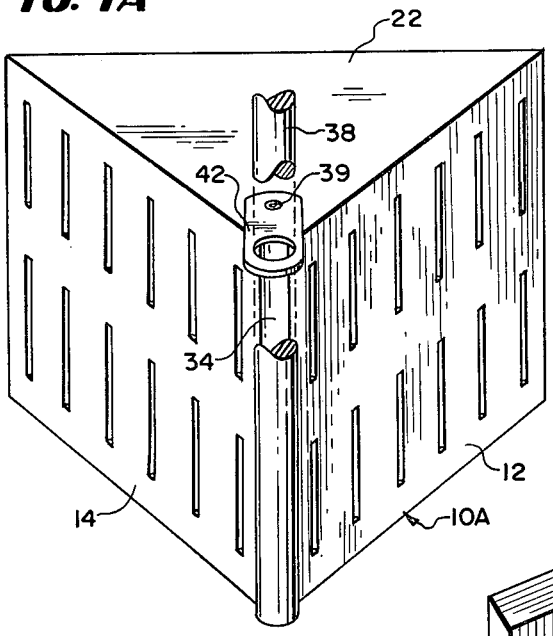
Figure 2A:
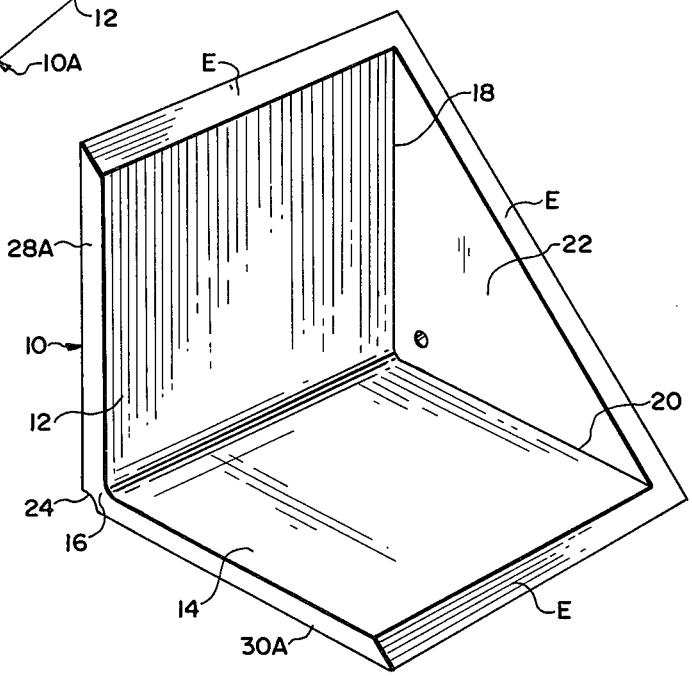
Figure 3A:
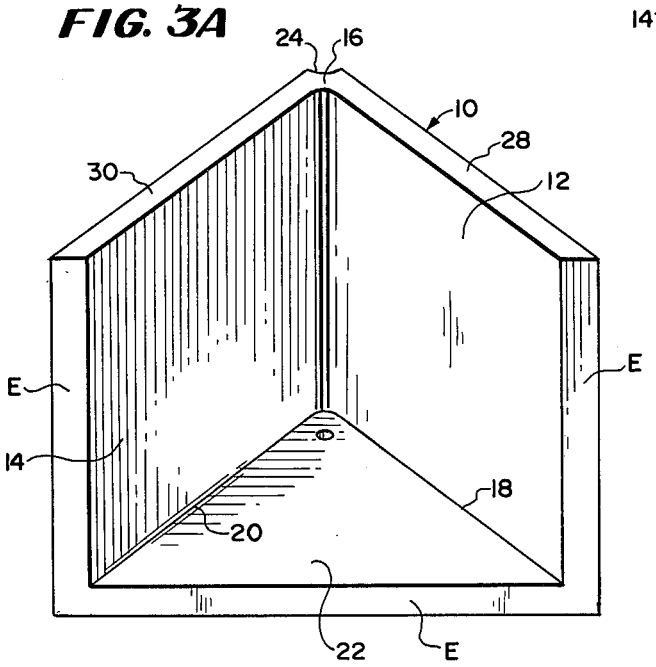

Referring now to the drawings in further detail, the unit 10 or 10A capitalizes on the versatility and decorativeness of a cubical geometric figure for basic uniformity of all major dimensions and orientations, the cube being useful and ornamental as well as structurally strong and compact, whether used as a solid or a shell.

However, a cube per se, geometrically, is unitary and uninteresting since it looks the same regardless of its orientation, its sides being equal and square, and, while it lends itself for use in straight-sided spaces such as in a store window or display cabinet, a large number of cubes have to be decorated differently and made of different sizes to provide versatility for sustained attention and interest where used in displaying merchandise. Where other geometric shapes are used for variety, the miscellany inventory of window display fixtures must be extensive if monotony is to be avoided.

In the present invention the very monotonous unity of the measurement of a cube is relied upon to provide attractive visual variations not only in cube assemblies but also the appearance of individual cubes, and, particularly for utilitarian purposes. Less than one half of the weight and geometry of a cube is employed as a building block or unit in substantial numbers for interestingly varying functional and appearance capabilities of display units for both concave inside exposures as well as convex outside display effects.

The basic unit 10 is preferably molded of polystyrene foam, as illustrated in detail in FIGS. 1–3 and 1A–3A. It has two square sides 12 and 14 joined at a right angle to each other along a common corner edge at 16 with both portions marginally interconnected along two diverging edges 18 and 20 by a planar isosceles right triangle side 22. The corner along the common edges 16 is preferably externally beveled with a quarter round contour, as at 24, and is internally rounded to eliminate structural sharp-corner weaknesses. This corner is generally either disposed vertically in weight-bearing relation or sidewise in carrying relation. The corners at 18 and 20 are subjected to weight-bearing compression forces and are designed square for nesting purposes in storage.

The exposed edges at 28 and 30 opposite the corners 18 and 20 are coplanar and square to the respective sides 12 and 14, respectively, in both embodiments illustrated in FIGS. 1–3 and 1A–3A. The construction of the edges E of the sides 12, 14 and 22 in FIGS. 1A–3A lie in the same plane which defines a 45° angle with respect to the sides 12 and 14 and a 90° angle with respect to the edges 28 and 30. The construction of the corresponding edges of the sides 12 and 14 in FIGS. 1–3 having mating interdigitating teeth EA and EB for locating and frictionally maintaining an assembled joint.

It will be observed that the interdigitating element castellation arrangements of EA and EB on the two edges are not symmetrical on opposite sides of their longitudinal mid-point. This not only provides an angular assemblability greater than an acute angle but also a ready referencing in correctly assembling the units for proper display purposes. This particularly tends to guide and determine the unitizing or cubing of the integrating assembly of the units for store display purposes.

Thus, when two units 10 or 10A are placed with their faces E face to face, a five-sided cube is defined with the sixth side open and surrounded by coplanar edges 28 and 30 defining an opening which provides access to the interior of the configuration. The external dimensions of all sides are equal and the thicknesses of all walls are the same. The unit, accordingly, can be located in any position or orientation in a given cubical space and a few representative arrangements are shown in succeeding figures.

Figure 4A:
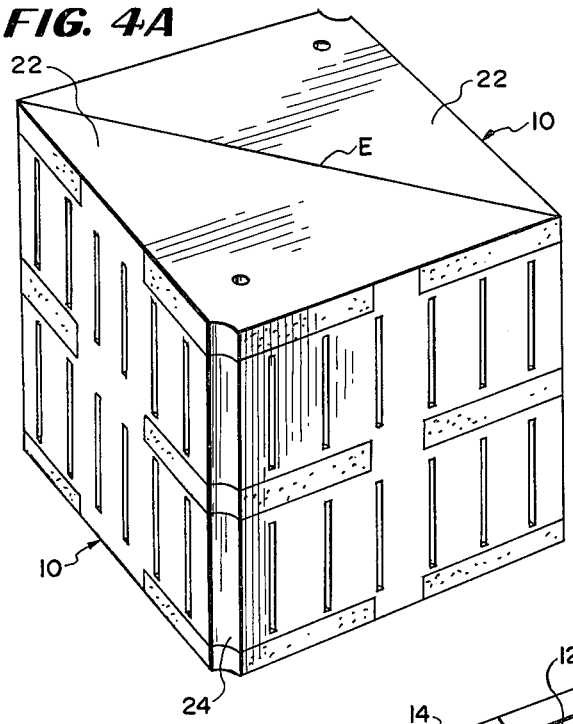
FIG. 4A is a fuller view similar to FIG. 1A illustrated in FIG. 1 and coacting to provide a stand having the appearance of a solid cube although open on the bottom.
Figure 4:
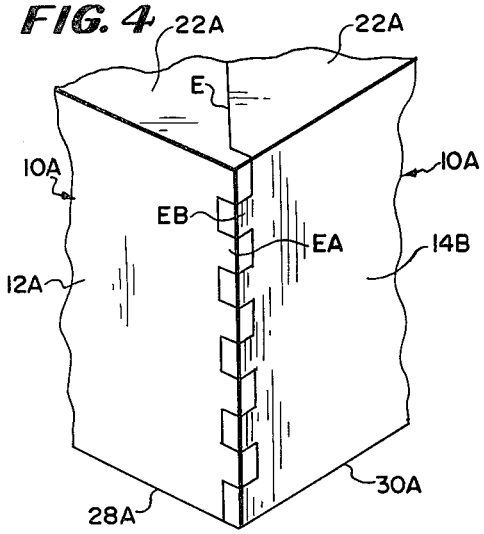
FIG. 4 illustrates the corner juncture of two assembled units as showing the external appearance of the intermeshing corners illustrated in FIGS. 1, 2 and 3.
Figure 11:
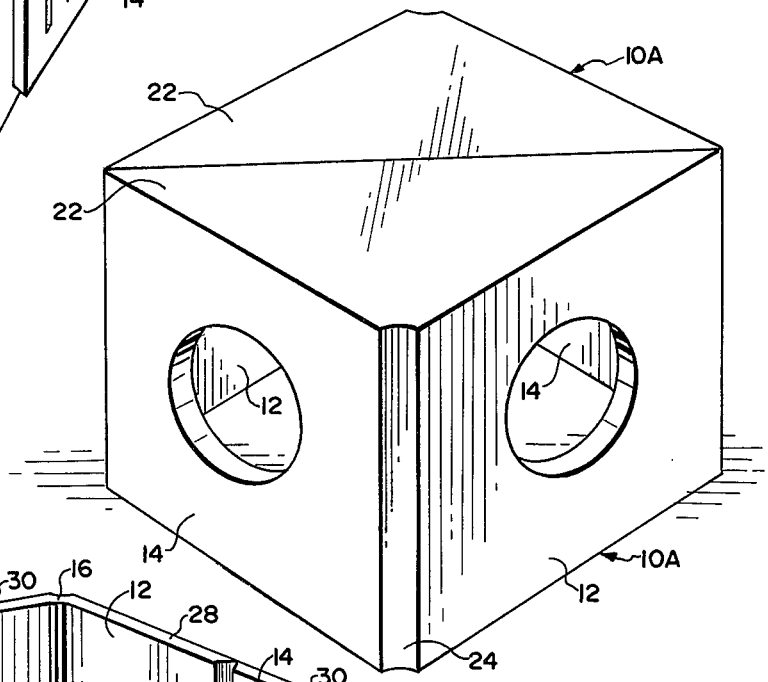
FIG. 11 is a view similar to FIGS. 4 or 4A illustrating a unit modification to provide display or access windows.

In each of FIGS. 4 or 4A and 11, two units are arranged with their edges E or EA and EB against or interlocked with each other, whichever the case may be, with the assembled configuration opening downward to form a stand which can both cover enclosed objects or support exposed objects on them at an elevation.

Figure 5:
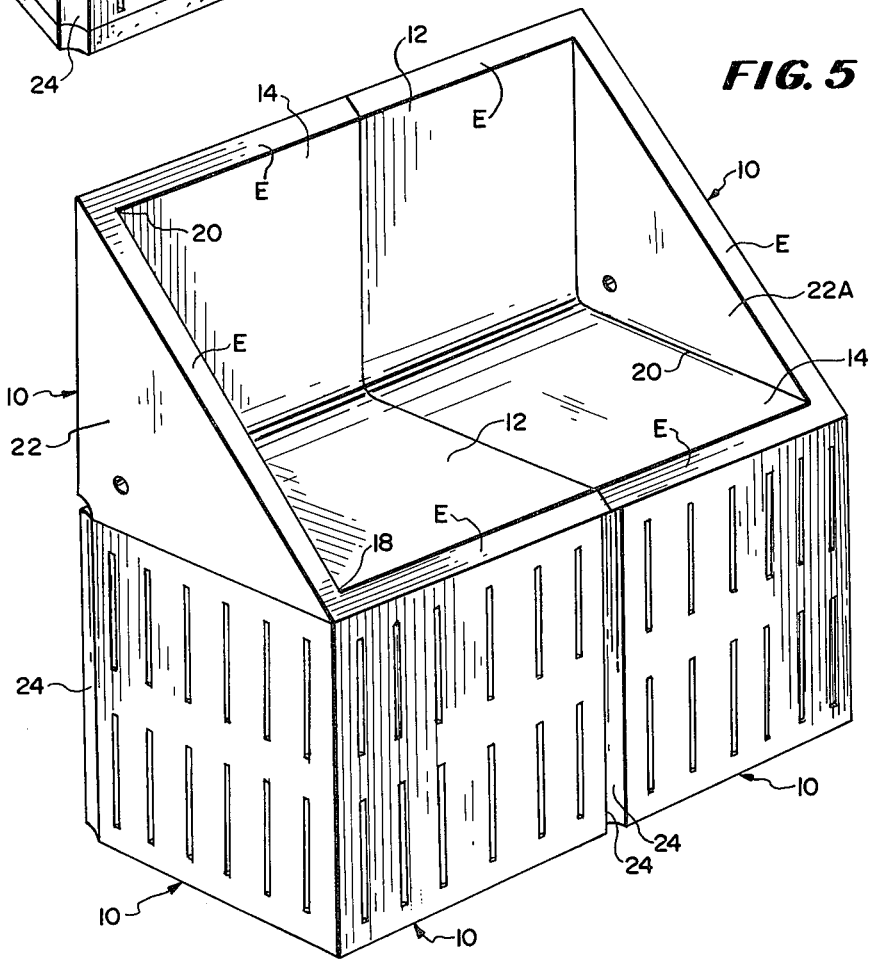
FIG. 5 illustrates the use of two cube-like assemblies shown in FIG. 4A side by side with either one of the two unit embodiments on top disposed as shown in FIG. 2 or 2A to provide an elevated display cubicle of perceptive depth.

FIG. 5, as already indicated, is made up of two stands such as shown in FIG. 4 or 4A and two units are disposed on top with their square side edges abutting against each other to provide a self-defining display cubicle with a back and sloping side.

Figure 6:
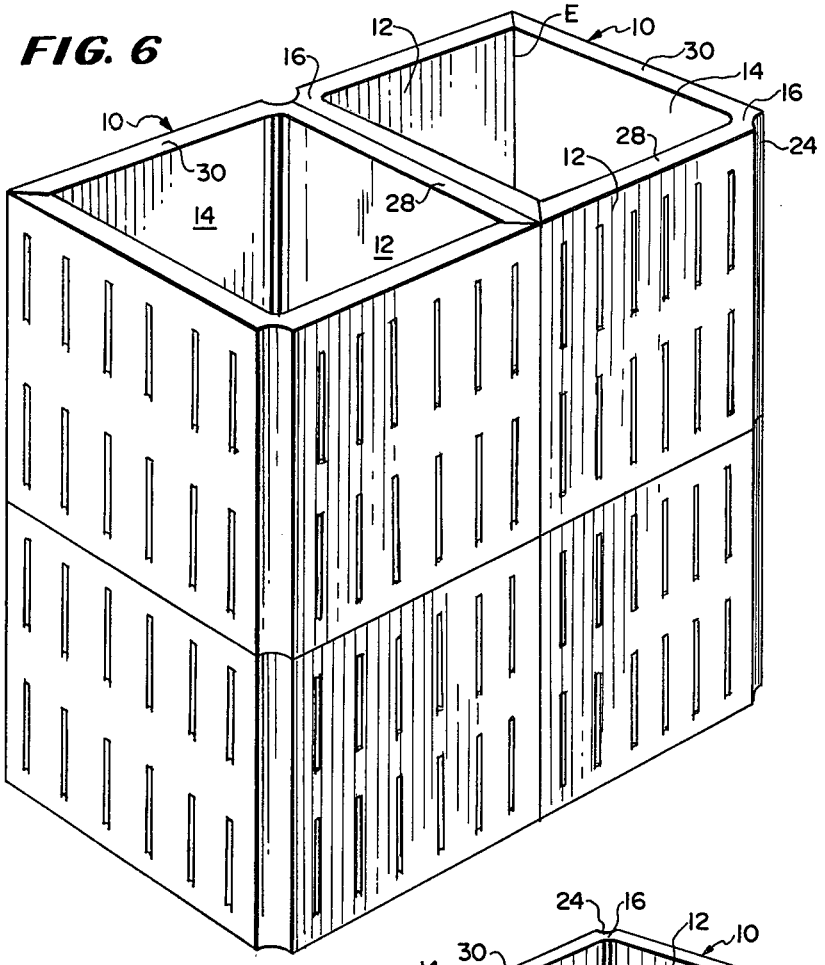
FIGS. 6 and 7 show representative display bin arrangements of double height having a single depth on top in FIG. 6 and either a double depth or a single depth bin in FIG. 7 for use of either or both unit embodiments of the invention.

FIG. 6 has a double base similar to FIG. 5, but two upwardly opening receptacles are located on top thereof.

Figure 7:
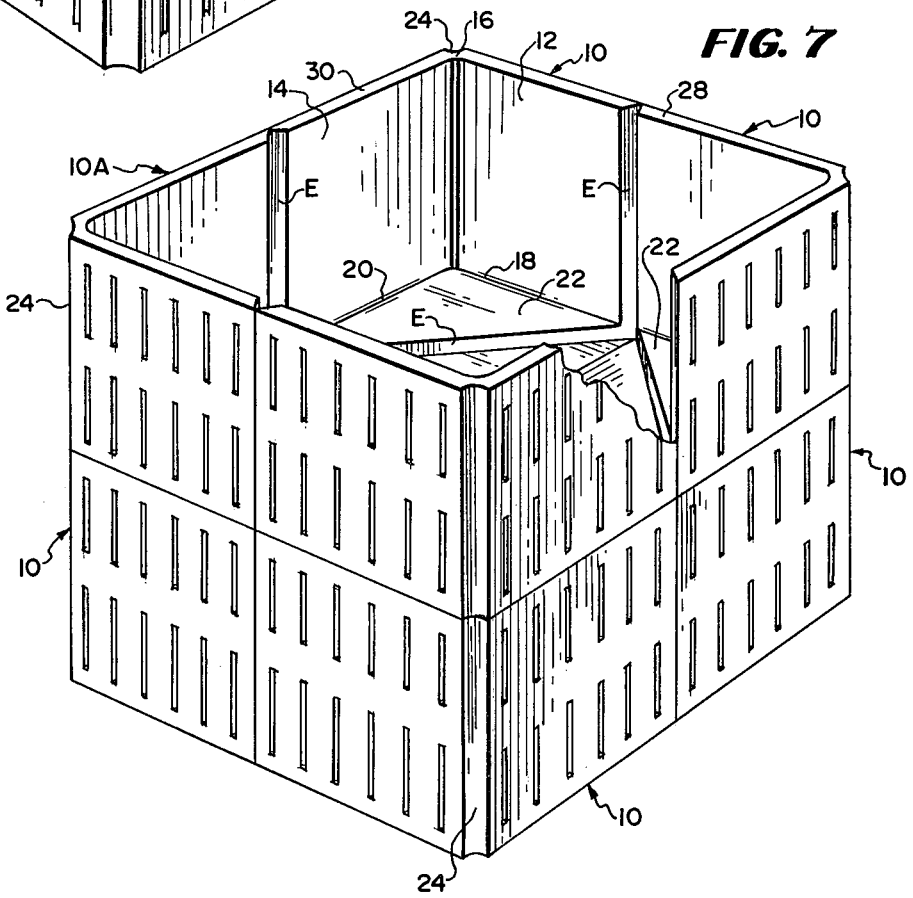
Figure 10:
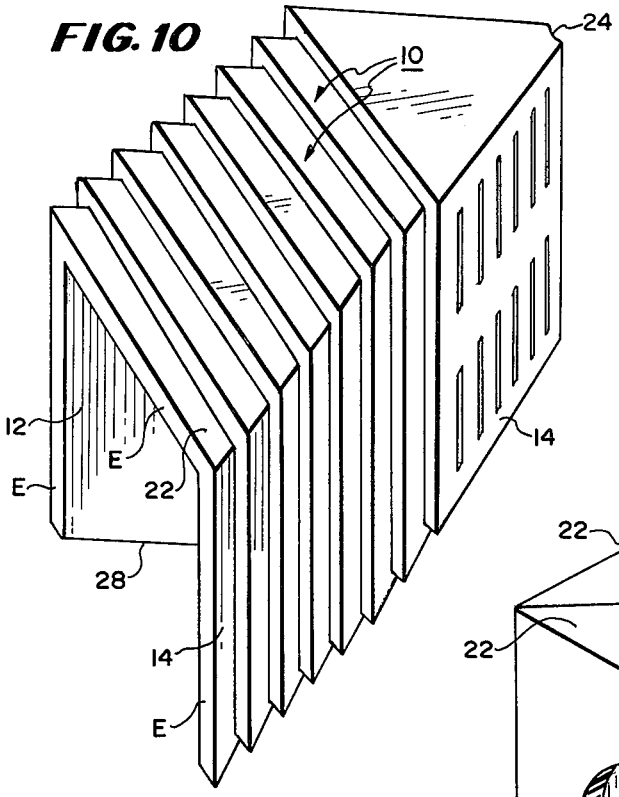
FIG. 10 shows the storage and transportation compactness of nested units of both modifications when they are not in use.

FIG. 7 discloses how four base units, arranged with each unit forming a corner receiving a like arrangement of four units on top provide a full depth large open bin effect.

FIG. 8 modifies FIG. 7 by moving the upper four-corner units outwardly to receive a square floor member 32 covering the bottom supporting units for either leaving vertical spaces between their edges or enabling them to be closed with insert tie plates 41. In this multiple embodiment of the invention the floor of the upper section is a square panel 32 that corners and covers the triangular elements 22 of the respective upper units as pinned thereto and to the triangular elements 22 of base assembly units by pins indicated at 36 that have tapered points 37 and flanged heads 39. Any articles placed on top the square panel will bear on the elements 22 and hold the square sides 12 and 14 in mutually supported upright position while several pins 36 through each element 22 will maintain orientation of the units.

Insert tie plates 41 are illustrated in FIGS. 8A and 8B. They are preferably arranged to mate with both the tapered edge E and toothed edges EA and EB (FIG. 3A) including side flanges 43 (FIG. 8) which overlap the edges E, EA and EB in pressure fitting relation. The teeth EA and EB intermesh in interdigitating, press fitting relation with mating teeth 45 located between the flanges and the mating teeth 45 are notched out at one side, as at 47, to accommodate the tapered edges E deeply enough for the flanges 43 to engage the faces of the sides 12 and 14 in supporting relationship. Otherwise, the panel 32 and pins 36 unitize the assembly.

In FIG. 9, four of the two-unit stands illustrated in FIG. 4 are shown where they preferably serve several additional purposes as well as being a base portion such as shown in FIG. 8. The central four units can be oriented with their quarter round portions 24 at their lowest position as mentioned with respect to FIG. 7, or at their top position as shown in FIG. 9, or alternately top and bottom, where their four adjacent mitered corners 24 provide a well 34 to receive and support a sign standard 38 as already suggested.

Figure 12:
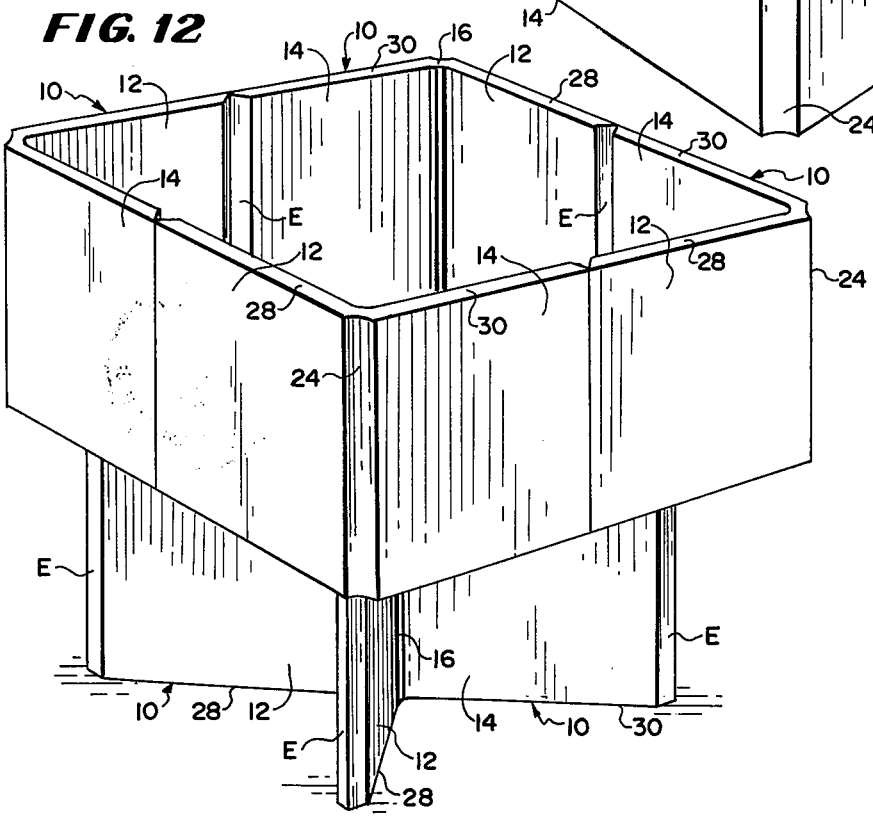
FIG. 12 is another assembly modification in which the base portion is a modification of that which is illustrated in FIG. 7.

In FIG. 12, the four central units of FIG. 9 are left in the orientation there shown with their triangular elements 22 uppermost and the four outer units can be inverted, raised to rest on the lower inner units as oriented in FIG. 7 but preferably with the sides 12 and 14 of the lower portions disposed normal to the hypotenuse sides E of the elements 22 thereof respectively.

Other configurations embodying various of these arrangements or decorations collectively provide a great number of pleasing fixture effects for great versatility with a minimum number of units.

What is claimed is:

1. A display fixture unit comprising six identical units, four of said identical units having flat square sides and forming a base of said display fixture unit; two of said identical units each having right angular disposed abutting surfaces, and each of said two units defining a pair of coplanar edge surfaces interconnecting and diverging at right angles from each of the opposite ends of the corner edge, and a planar isosceles right triangular wall interconnecting only one of the pairs of parallel coplanar edges and having its hypotenuse edge coplanar with said coplanar edges, the remaining triangular space being open; wherein said four identical units having edge configurations defining face-to-face engaging surfaces disposed at a 45° angle to the plane of the square sides of said units.

2. The display fixture unit defined in claim 1 in which the right angle juncture between the two sides in externally beveled at the exterior corner with a quarter round contour.

* * * * *